US005376942A

United States Patent [19]

Shiga

[11] Patent Number: 5,376,942

[45] Date of Patent: Dec. 27, 1994

[54] RECEIVING DEVICE WITH SEPARATE SUBSTRATE SURFACE

[75] Inventor: Nobuo Shiga, Yokohama, Japan

[73] Assignee: Sumitomo Electric Industries, Ltd., Osaka, Japan

[21] Appl. No.: 928,481

[22] Filed: Aug. 12, 1992

[30] Foreign Application Priority Data

Aug. 20, 1991 [JP] Japan ..... 3-208123
Aug. 28, 1991 [JP] Japan ..... 3-217173

[51] Int. Cl.[5] ..... H01Q 1/38
[52] U.S. Cl. ..... 343/700 MS
[58] Field of Search ..... 343/700 MS, 795, 853; 33/246, 247; 455/313, 276, 310, 311; 257/618, 678; H01Q 1/38

[56] References Cited

U.S. PATENT DOCUMENTS 4,490,721 12/1984 Stockton et al. ..... 343/700 MS
4,801,943 1/1989 Yabu et al. ..... 343/823
4,896,194 1/1990 Suzuki ..... 257/618
4,965,605 10/1990 Chang et al. ..... 343/700 MS
5,125,109 6/1992 Geller et al. ..... 455/313
5,202,752 4/1993 Honjo ..... 257/703

FOREIGN PATENT DOCUMENTS 346125 9/1986 European Pat. Off. .
193849 12/1989 European Pat. Off. .
0196705 8/1991 Japan ..... 343/700 MS

OTHER PUBLICATIONS

Takahashi, Akira "Recent Trends of Receiving Antennas For Satellite Broadcasting", *MWE '92 Microwave Workshop Digest*, pp. 439–444.
Christian Kermarrec et al., "The First Integrated Microwave Receiver DBS Applications At 12 GHz," from *14th European Microwave Conference*, pp. 749–754, presented Sep., 1984.
Koichi Ito et al., "Planar Antennas For Satellite Reception," from *IEEE Transactions On Broadcasting*, vol. 34, No. 4, pp. 457–464, Dec. 1988.

*Primary Examiner*—Donald Hajec
*Assistant Examiner*—Tan Ho
*Attorney, Agent, or Firm*—Beveridge, DeGrandi, Weilacher & Young

[57] ABSTRACT

A plane antenna 2 and a receiving circuit 5 are formed on one and the same semiconductor substrate 1. Both can be connected by a microstrip line 7, and so on. Resultantly the receiving device as a whole can be small-sized and light. Furthermore, the plane antenna, the receiving circuit, and the microstrip line can be integrated by the common IC process, and the fabrication cost can be drastically reduced.

18 Claims, 7 Drawing Sheets

RECEIVING DEVICE WITH SEPARATE SUBSTRATE SURFACE

BACKGROUND OF THE INVENTION

1. Field of the Invention

This invention relates to a receiving device for receiving on the ground microwave signals from communication satellites, broadcasting satellites and so on, specifically a receiving device comprising a plane antenna, a low-noise amplifying circuit connected with the plane antenna, and so on.

2. Related Background Art

Accompanying the rapid development of information networks, the demand for satellite communication systems is on rapid increase, and frequencies in the microwave band are increasingly used. As high-frequency field-effect transistors, Schottky barrier field-effect transistors (MESFETs) of compound semiconductors, as of GaAs or others, are practically used. Furthermore, recently first stage amplifying units of downconvertors for converting high-frequency signals to low-frequency signals are increasingly provided in microwave monolithic integrated circuits (MMICs).

On the other hand, plane antennas begin to be practically used as antennas for receiving on the ground microwave signals from communication satellites and broadcasting satellites. A plane antenna comprises a number of antenna elements arranged in plane, signal powers received by the respective antenna elements being collected by conductors. The plane antenna for receiving microwaves was at start far behind parabolic antennas in terms of performance and costs. But since the latter half of the 1970's microstrip antennas have been increasingly studied, and the performance of microwave print substrates have been improved, and presently microstrip antennas have reached the practical level.

But the means for connecting the receiving circuits provided in MMICs to plane antennas has not been sufficiently studied. For example, in using, as means for connecting both, a waveguide, which is common microwave transmission means, it is difficult to achieve the miniaturization and the reduction of a weight as a whole, and the successful miniaturization of the receiving circuits and the successful planarization of antennas cannot be made effective use of.

SUMMARY OF THE INVENTION

An object of this invention is to miniaturize and lighten a receiving device comprising a plane antenna and a receiving circuit.

To achieve this object, the receiving device according to this invention has a structure in which a plane antenna including an antenna element arranged in plane, and a receiving circuit connected to the plane antenna are formed on one and the same semiconductor substrate. Since the plane antenna and the receiving circuit are formed on one and the same semiconductor substrate, both can be connected by a microstrip line. The receiving device can be miniaturized and lightened as a whole. In such case, all the plane antenna, the receiving circuit, and the microstrip line can be integrated by the common IC process.

The semiconductor substrate can be provided by a silicon substrate or a compound semiconductor substrate. In the case that a silicon substrate is used, it is preferable that an spitaxial compound semiconductor layer is formed on a part of the top of the silicon substrate, the plane antenna is formed on the top of the silicon substrate, and the receiving circuit is formed on the top of the spitaxial compound semiconductor layer. By forming the plane antenna on a silicon substrate having a comparatively low relative dielectric constant $\epsilon$ of 11.9, a wider frequency band width can be available for the antenna, compared with the case that the plane antenna is formed on a semi-insulating compound semiconductor substrate of GaAs. On the other hand, it is known that it is difficult due to low resistance values and low electron mobilities of silicon substrates to monolithically form on a silicon substrate a receiving circuit (low-noise amplifying circuit and so on) suitable for signals of high frequencies in the microwave band. In view of this, according to one aspect of this invention, a compound semiconductor layer is crystal-grown on a part of the top of a silicon substrate, so that a receiving circuit can be easily formed on the top of the compound semiconductor layer. Consequently a plane antenna having a wide frequency band, and the receiving circuit can be mounted on one and the same substrate.

It is possible to form a plane antenna on the top (or the backside) of one semiconductor substrate, and a receiving circuit on the backside (or the top) of the substrate. In this case, the plane antenna and the receiving circuit are connected by a plane transmission line and a via hole.

Furthermore, according to another aspect of this invention, this invention relates to a receiving device comprising a plurality of plane antenna element groups including one or more than two antenna elements, a plurality of low-noise amplifying circuits each connected to each of the plane antenna element groups, and a microstrip line connected commonly to output terminals of the low-noise amplifying circuits, the plane antenna element groups, low-noise amplifying circuits, and the microstrip line being formed on one and the same semiconductor substrate.

According to further another aspect of this invention, this invention relates to a receiving device comprising a plane antenna element group including one or more than two antenna elements, and a low-noise amplifying circuit connected to the plane antenna element group, the plane antenna element group and the low-noise amplifying circuit being formed on one and the same semiconductor substrate, a plurality of the semiconductor substrates being arranged on a dielectric substrate, the output terminals of low-noise amplifying circuits formed corresponding to the respective semiconductor substrates being connected to one output terminal by a microstrip line.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

DESCRIPTION OF THE PREFERRED EMBODIMENT

Figure 1:
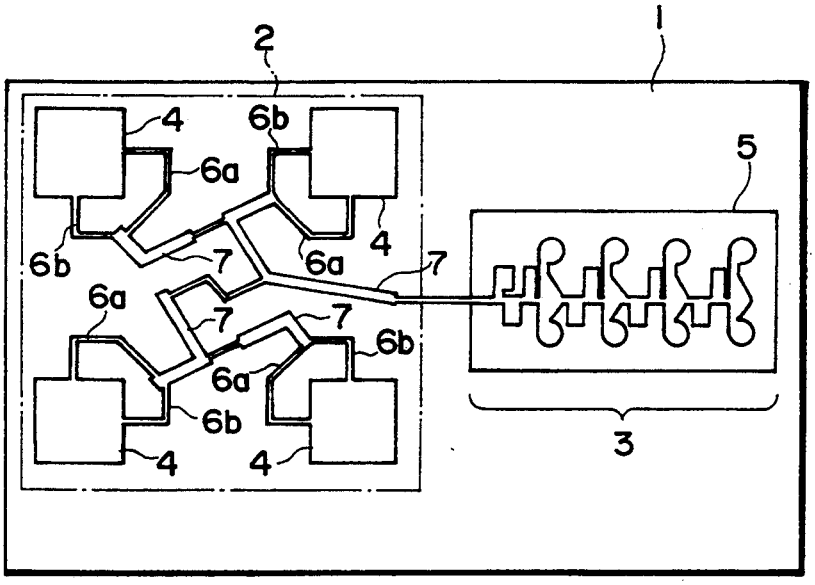
FIG. 1 is a plan view of a first embodiment of this invention.

A first embodiment of this invention will be explained with reference to FIG. 1.

A semi-insulating compound semiconductor layer 5 of GaAs is formed on a part of the top of a silicon substrate 1. This GaAs layer 5 may be epitaxially grown selectively on a necessary part, and otherwise may be epitaxially grown on the entire top of the silicon substrate 1 and then etched off at an unnecessary part. A grounding conductor is formed on the entire backside of the silicon substrate 1.

A plane antenna 2 is formed in a region of the top of the silicon substrate 1 where the GaAs layer 5 is not formed. The plane antenna 2 includes four antenna elements 4. Each of the antenna elements 4 is of two-point fed type which is well known as a microstrip patch antenna. Lengths of feeding lines 6*a*, 6*b* are so set that the line 6*a* is longer than the line 6*b* by $\frac{1}{4}$ wavelength, whereby circularly polarized waves can be emitted. The feeding lines 6*a*, 6*b* of each of the patch antennas 4 are connected to its associated one of four feeding lines 7. A line width of the feeding lines 7 is larger than that of the feeding lines 6*a*, 6*b* for impedance matching.

The feeding lines 7 of the respective antenna elements 4 are connected commonly to a low-noise amplifier 3 as a receiving circuit. This low-noise amplifier 3 includes a MESFET and so on integrated on the GaAs layer 5. GaAs, which has high electron mobilities and high bulk resistance values, is suitable to monolithically form a receiving circuit for high frequencies. On the other hand, silicon (Si) forming the substrate 1 has a relative dielectric constant $\epsilon$ of 11.9, which is lower than that of GaAs. Accordingly this plane antenna 2 can have a wider frequency band compared with the case that the same plane antenna is formed on a GaAs substrate.

The feeding lines 6*a*, 6*b*, and 7 are a microstrip line, and their characteristic impedances are considered.

Thus, the receiving device according to the first embodiment has the plane antenna 2, and the low-noise amplifier 3 as the receiving circuit formed on the silicon substrate 1, and can be small-sized and light to be easily handled.

In the first embodiment, the receiving circuit is provided by the low-noise amplifier 3, but may include, in addition to the low-noise amplifier 3, a frequency converting circuit for down-converting a frequency of an output signal of the low-noise amplifier 3, a circuit for amplifying an output signal of the frequency converting circuit, and so on integrated on the GaAs layer 5.

In applying this receiving device to mobile objects, such as automobiles, in order to receive microwave signals from communication satellites and broadcasting satellites, it is preferable that means for electronically tracing directions of the satellites, i.e., a phase shifting circuit for shifting a phase of a received microwave signal is built in the receiving circuit.

In the first embodiment, a patch antenna is used as the antenna element 4, but the patch antenna element 4 may be replaced by another line-type, spiral type- or other type-print antenna.

Next, a second embodiment of this invention will be explained with reference to FIG. 2. In the second embodiment, the plane antenna is more integrated than in the first embodiment.

Figure 2:
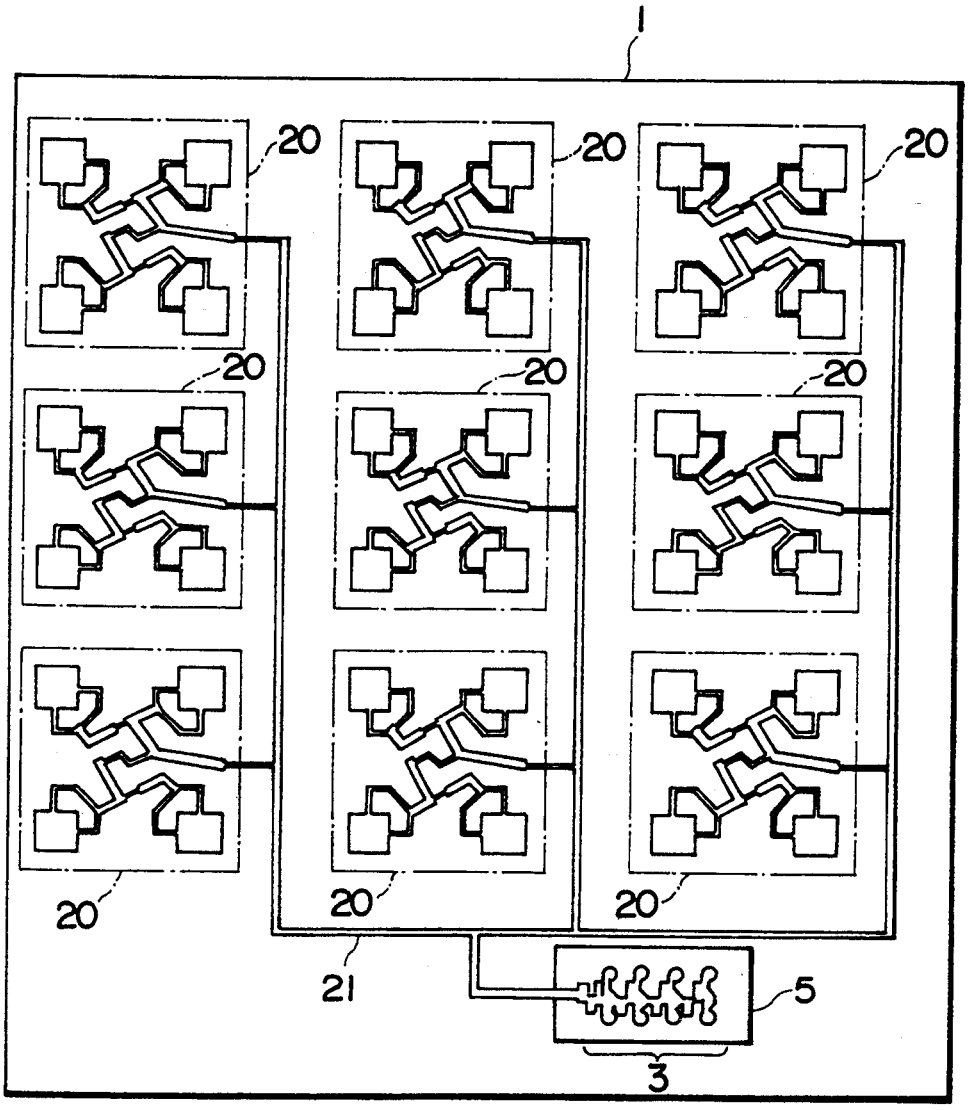
FIG. 2 is a plan view of a second embodiment of this invention.

FIG. 2 is a plan view of the receiving device according to the second embodiment of this invention. In the second embodiment, a plane antenna 2 constituted by four antenna elements in the first embodiment is used as a plane antenna element group 20, and a plurality of the plane antenna element groups 20 (nine in the second embodiment) are arranged in plane on the top of a silicon substrate 1. The respective plane antenna element group 20 are connected to a low-noise amplifier 3 formed on a GaAs layer 5 by a microstrip line 21. It is possible to increase a number of the plane antenna element group 20 as many as possible. The receiving capacity and accuracy of the receiving device can be improved by an increase in a number of the plane antenna element group 20. A number of the antenna element constituting the plane antenna element group 20 is four as in the first embodiment, but the number is not essentially limited to four.

Figure 3:
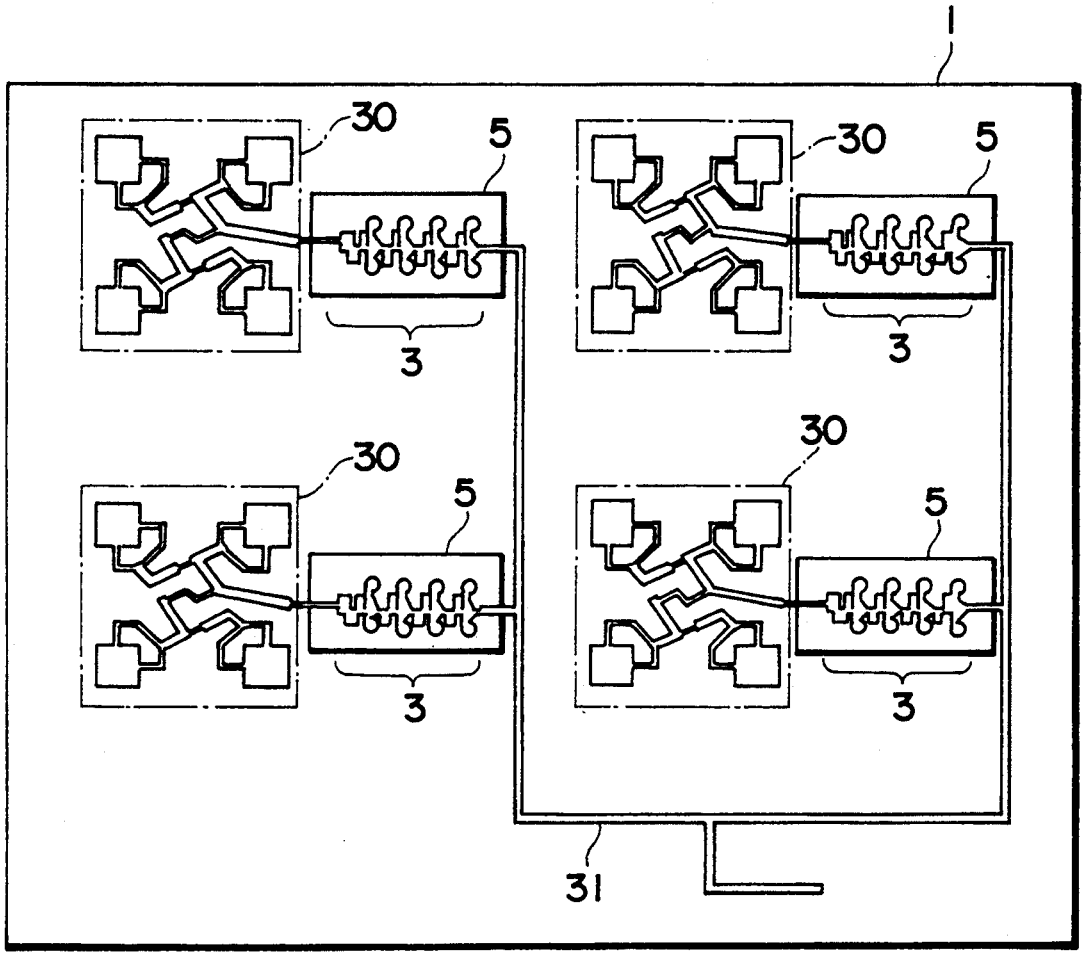
FIG. 3 is a plan view of a third embodiment of this invention.

FIG. 3 is a plan view of a third embodiment of this invention. In the third embodiment as well as the second embodiment, one plane antenna element group 30 is constituted by four antenna element. Four plane antenna element groups 30 are arranged in plane on a silicon substrate 1. Each plane antenna element group 30 is connected to one low-noise amplifier 31 as a receiving circuit, and the output terminals of the respective low-noise amplifiers 3 are connected commonly to a microstrip line 31. Generally a cause for the fact that the efficiency of a plane antenna cannot be easily improved is large losses in the feeding system. But the noise figure can be drastically improved by adding a low-noise amplifier to each plane antenna element group 30 as in the third embodiment.

The above-described first to the third embodiments use silicon substrates having compound semiconductor layers provided partially on the top. But it is also possible to use a compound semiconductor substrate, as of GaAs, in place of the silicon substrates, mount a plane antenna and a receiving circuit on the substrate, and connect both by a microstrip line. The latter case has a disadvantage that the compound semiconductor substrate has a higher relative dielectric constant $\epsilon$ than the silicon substrates, and accordingly has a narrower receiving frequency band. But an advantage is that GaAs MESFETs suitable for a microwave receiving circuit can be easily formed.

Figure 4A:
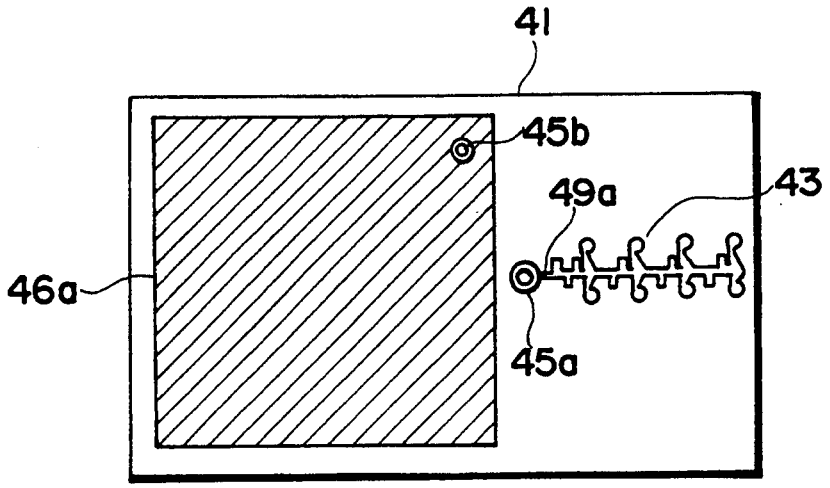
FIG. 4A and 4B are plan views of a fourth embodiment of this invention.
Figure 4B:
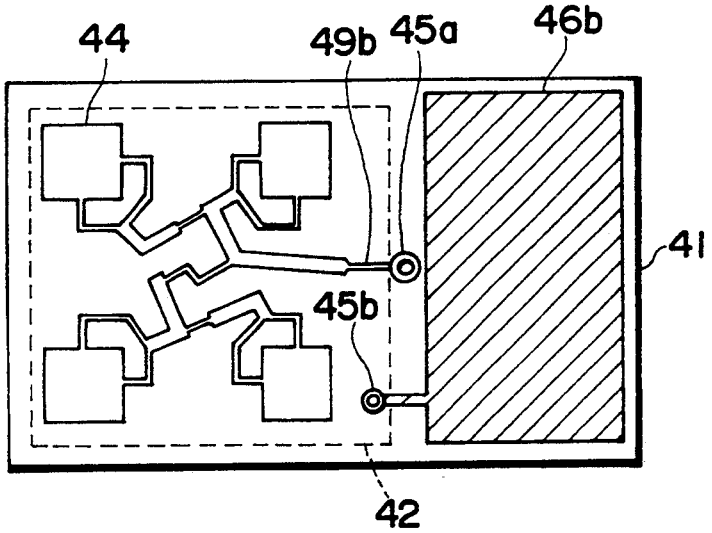

Next a fourth embodiment of this invention will be explained with reference to FIGS. 4A and 4B. On the top of a semi-insulating semiconductor substrate 41 of, e.g. GaAs, with a semiconductor layer epitaxially grown on there is monolithically formed a receiving circuit 43. On a part of the top of the substrate 41 corresponding to a plane antenna 42 provided on the backside of the substrate 41, there is formed a ground pattern 46*a*. The plane antenna 42 is formed on the backside of the substrate 41, and a ground pattern 46*b* is formed on a part of the backside of the substrate 41 corresponding to the receiving circuit 48 formed on the top of the substrate 41. The plane antenna 42 and the receiving circuit 43 are electrically connected to each other by a via hole 45*a* formed in the semi-insulating semiconductor substrate 41 and microstrip lines 49*a*, 49*b* which are plane transmission lines. The ground patterns 46*a* and 46*b* are connected to each other through a via hole 45*b*. The plane antenna 42 includes four antenna elements 44, and each antenna element 44 is of two-point fed type, which is well known as a microstrip patch antenna. The feeding lines of the respective antenna elements 44 are collected together to be connected to the receiving circuit 43 through the microstrip lines 49*a*, 49*b* and the via hole 45*a*. This receiving circuit 43 is a low-noise amplifier having MESFETs using the epitaxial semiconductor layer on the semiconductor substrate, and so on integrated. Thus, the plane antenna 42 and the receiving circuit 43 are formed respectively on the top and the backside of one substrate 41. In some cases this facilitates the practical mount of the receiving device according to this invention.

In the fourth embodiment as well as the first to the third embodiments, the receiving circuit is provided by the low-noise amplifier, but may have, in addition to the low-noise amplifier, a frequency converting circuit for down-converting a frequency of an output signal of the low-noise amplifier, a circuit for amplifying an output signal of the frequency converting circuit, and so on integrated.

In applying this receiving device to mobile objects, such as automobiles, it is preferable that means for electronically tracing directions of the satellites, i.e., a phase shifting circuit for shifting a phase of a received microwave signal is built in the receiving circuit. In the fourth embodiment, a patch antenna is used as the antenna element 44, but the patch antenna element 4 may be replaced by another line-type, spiral type- or other type-print antenna.

Figure 5A:
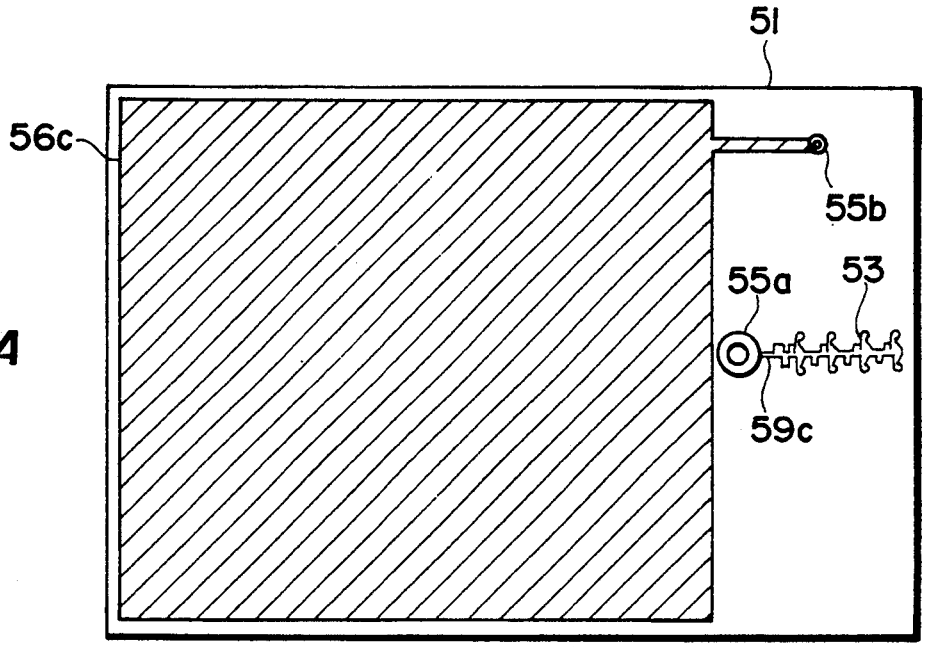
FIG. 5A and 5B are plan views of a fifth embodiment of this invention.
Figure 5B:
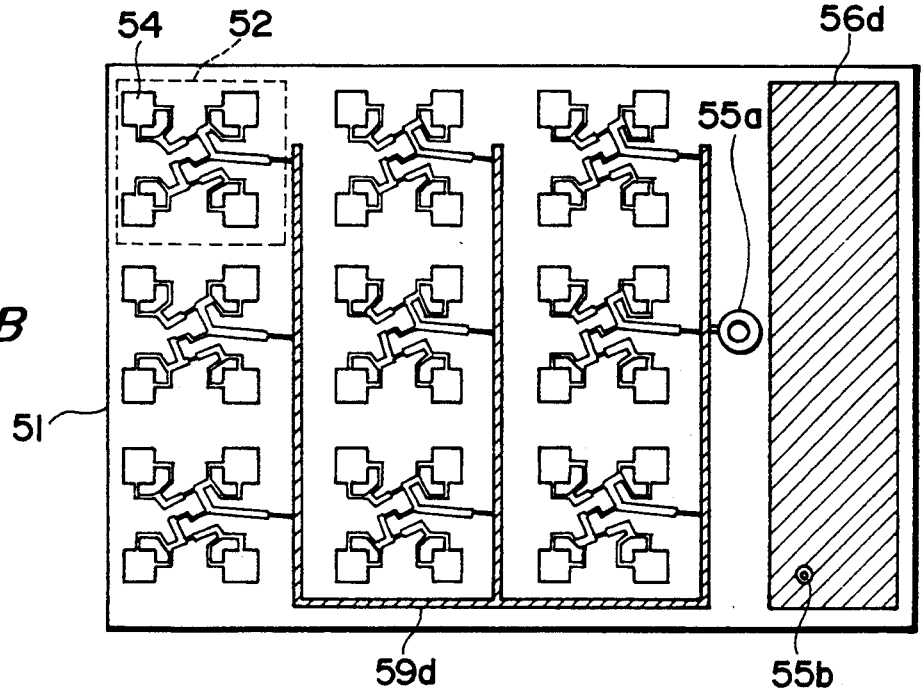

FIGS. 5A and 5B are plan views of the receiving device according to a fifth embodiment of this invention. More antenna elements are integrated. As shown in FIGS. 5A and 5B, microwave signal outputs from respective plane antenna element groups 52 are collected by a microstrip line 59*d* to be received by a receiving circuit 53 through a via hole 55*a* and a microstrip line 59*c*. A via hole 55*b* connects ground patterns 56*c* and 56*a*. Thus, a number of the antenna element can be increased as far as a space permits, and the receiving capacity and accuracy are improved by an increase in a number of the antenna element.

Figure 6A:
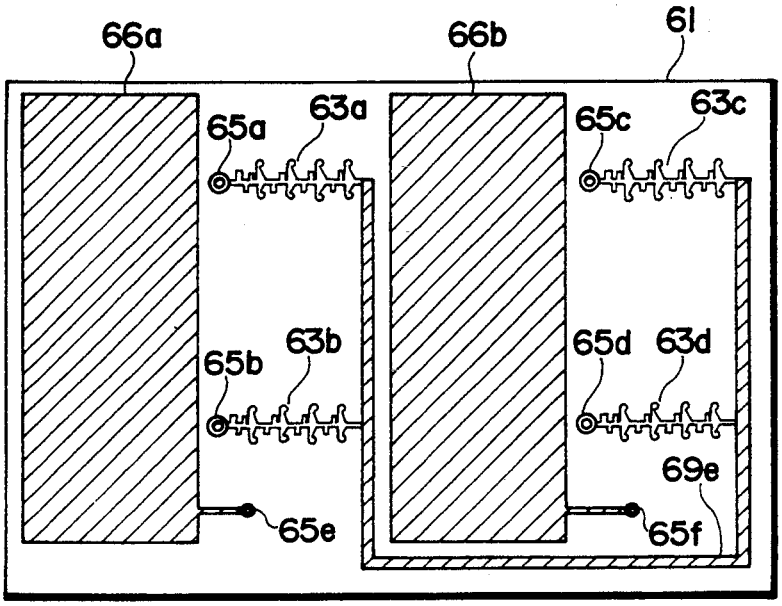
FIG. 6A and 6B are plan views of a sixth embodiment of this invention.
Figure 6B:
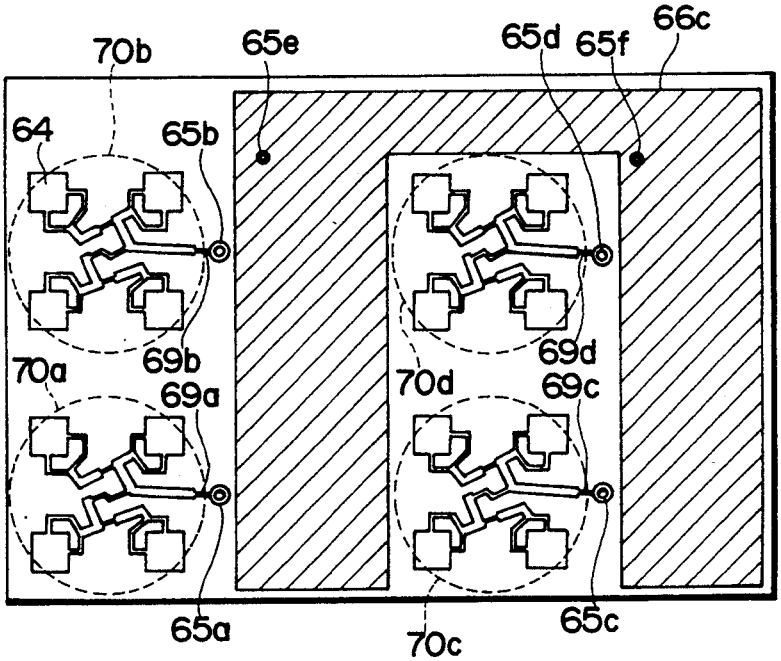

FIGS. 6A and 6B are plan views of a sixth embodiment of this invention. The sixth embodiment has the same basic constitution as the third embodiment. In this receiving device according to the sixth embodiment, four antenna elements 64 constitute one plane antenna element group, and four plane antenna element groups 70*a*~70*d* are arranged in plane on a semiconductor substrate 61. Each plane antenna element group 70*a*~70*d* is connected (through via holes 65*a*~65*d*) to one low-noise amplifier 63*a*~63*d* which provides one receiving circuit. The output terminals of the low-noise amplifiers 63*a*~63*d* are connected commonly to a microstrip line 69*d*. Ground patterns 65*e* and 65*f* are connected to each other through via holes 65*e* and 65*f*. Generally a cause for the fact that the efficiency of a plane antenna cannot be easily improved is large losses of the feeding system. But as in this embodiment, noise figures can be much improved by adding one low-noise amplifier 63*a*~63*d* to each of the plane antenna element groups 70*a*~70*d*.

Figure 7:
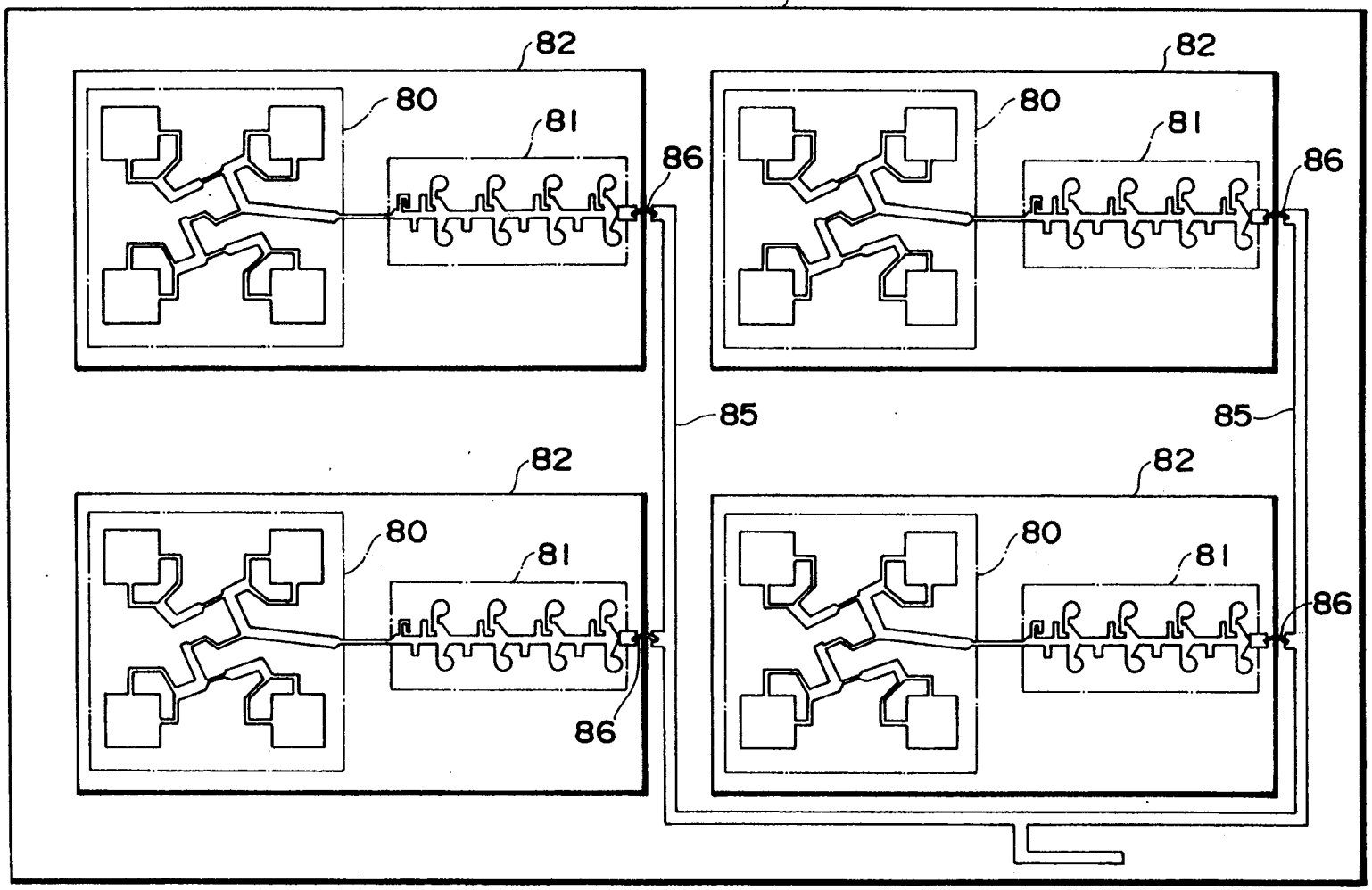
FIG. 7 is a plan view of a seventh embodiment of this invention.

Then a seventh embodiment of this invention will be explained with reference to FIG. 7. In the above-described first to the sixth embodiments, all the plane antenna element groups, and the low-noise amplifiers are monolithically integrated on one semiconductor substrate. But in the seventh embodiment, a plural number of the receiving device according to the first embodiment are hybrid-integrated, and a receiving device which can compete with the third and the sixth embodiments. That is, one plane antenna element group 80, and one low-noise amplifier 81 are monolithically formed on one silicon substrate 82 as in the first embodiment of FIG. 1. A plural number of the silicon substrate 82 are mounted on a dielectric substrate 84, as of foamed polyethylene, having a low dielectric constant more suitable for plane antennas than semiconductor, and having a small tan $\delta$. The low-noise amplifiers 81 of the respective silicon substrates 82 are connected through conductor wires 88 to a microstrip line 85 formed on the foamed polyethylene substrate 84. In this case, because of the low dielectric constant, a propagation velocity of microwaves is high.

The above-described embodiments relate to receiving devices for directly receiving microwaves from communication satellites and so on, but can be used as primary radiators for use in parabolic antennas.

As described above, the receiving device according to this invention includes a plane antenna and a receiving circuit mounted on one and the same substrate. Resultantly the receiving device as a whole can be small-sized and light. The receiving devices according to the first to the third embodiments, which use as the substrates silicon substrates having comparatively low relative dielectric constants $\epsilon$, allow the plane antenna to have wide frequency bands. Furthermore, the selective epitaxial growth of a semi-insulating semiconductor layer on a silicon substrate, and the formation of the receiving circuit on a semi-insulating semiconductor layer make the receiving circuit suitable for high frequencies. In addition, because, in comparison with a semi-insulating compound semiconductor substrate, a silicon substrate allows for larger bores, it is possible to fabricate receiving devices with a large number of antenna elements arranged. In the receiving devices according to the fourth to the sixth embodiments, the receiving circuit is formed on the backside of the plane antenna. Resultantly, in using the receiving devices as primary radiators of parabolic antennas, the receiving circuits are less susceptible to the influence of collected electromagnetic waves, and, in addition, in actual applications a degree of freedom of taking out convertor outputs is increased.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

I claim:

1. A microwave receiving device, comprising:

a semiconductor substrate;

a plane antenna including an antenna element formed on said semiconductor substrate;

a compound semiconductor layer formed on said semiconductor substrate; and a receiving circuit formed on said compound semiconductor layer and electrically connected to said plane antenna.

2. A microwave receiving device according to claim 1, wherein said semiconductor substrate is a silicon substrate.

3. A microwave receiving device according to claim 2, wherein said compound semiconductor layer has been crystal-grown at a region on a surface of said silicon substrate;

said receiving circuit has been formed on said compound semiconductor layer; and said antenna element has been formed on a region of said silicon substrate other than said region on which said compound semiconductor layer has been formed.

4. A microwave receiving device according to claim 2, wherein said plane antenna and said receiving circuit are connected by a microstrip line.

5. A microwave receiving device according to claim 2, wherein said receiving circuit includes a low-noise amplifying circuit for amplifying a signal received by said plane antenna.

6. A microwave receiving device according to claim 5, wherein said receiving circuit includes a frequency converting circuit for down-converting a frequency of an output signal of said low-noise amplifying circuit.

7. A microwave receiving device comprising:

a semiconductor substrate;

a plane antenna including an antenna element formed on a first predetermined portion of one surface of said semiconductor substrate; and a receiving unit formed on a compound semiconductor layer provided on a second predetermined portion of another surface of said semiconductor substrate and connected to said plane antenna through a via hole formed in said semiconductor substrate, said first and second predetermined portions being arranged so as not to face each other along plane parallel with said semiconductor substrate.

8. A microwave receiving device according to claim 7, wherein said semiconductor substrate is silicon substrate.

9. A microwave receiving device according to claim 7, wherein said compound semiconductor substrate is a GaAs substrate.

10. A microwave receiving device according to claim 7, wherein said plane antenna and said receiving circuit are connected by a microstrip line.

11. A microwave receiving device according to claim 7, wherein said receiving circuit includes a low-noise amplifying circuit for amplifying a signal received by said plane antenna.

12. A microwave receiving device according to claim 11, wherein said receiving circuit includes a frequency converting circuit for down-converting a frequency of an output signal of said low-noise amplifying circuit.

13. A microwave receiving device comprising:

a semiconductor substrate;

a plurality of plane antennas, each of said plane antennas including an antenna element formed on said semiconductor substrate;

a compound semiconductor layer formed on said semiconductor substrate; and a plurality of low-noise amplifying circuits formed on said compound semiconductor layer, each of said low-noise amplifying circuits being connected to each of said plane antennas in one-to-one correspondence.

14. A microwave receiving device according to claim 13, wherein said semiconductor substrate is a silicon substrate.

15. A microwave receiving device according to claim 14, wherein said compound semiconductor layer has been crystal-grown at a region on a surface of said silicon substrate;

said low-noise amplifying circuits are formed on said compound semiconductor layer; and said plane antennas are formed in a region of said silicon substrate other than said region where said compound semiconductor layer region has been formed.

16. A microwave receiving apparatus comprising:

a dielectric substrate;

a plurality of microwave receiving devices, each of said microwave receiving devices comprising:

a semiconductor substrate mounted on said dielectric substrate;

a plane antenna including an antenna element formed on said semiconductor substrate;

a compound semiconductor layer mounted on said semiconductor substrate;

a low-noise amplifying circuit formed on said compound semiconductor layer and connected to said plane antenna, and a microstrip line circuit formed on said dielectric substrate for connecting a plurality of said microwave receiving devices.

17. A microwave receiving apparatus according to claim 16, wherein said semiconductor substrate is a silicon substrate.

18. A microwave receiving apparatus according to claim 17, wherein said compound semiconductor layer has been crystal-grown at a region on a surface of said silicon substrate;

said low-noise amplifying circuits have been formed on said compound semiconductor layer; and said plane antenna has been formed in a region of said silicon substrate other than said region where said compound semiconductor layer region has been formed.

* * * * *